United States Patent [19]

Klaczak et al.

[11] Patent Number: 4,896,805

[45] Date of Patent: Jan. 30, 1990

[54] CERTAIN IMPROVEMENTS TO A PAGER CARRYING CASE

[75] Inventors: Lynne D. Klaczak, Boynton Beach; Marilyn S. Burger, Pompano Beach, both of Fla.

[73] Assignee: Motorola, Inc., Schaumburg, Ill.

[21] Appl. No.: 227,042

[22] Filed: Aug. 1, 1988

[51] Int. Cl.[4] ..... A45F 5/02

[52] U.S. Cl. ..... 224/236; 224/252; 224/253; 224/151; 224/901

[58] Field of Search ..... 224/252, 253, 151, 195, 224/269, 901, 236, 237; 2/DIG. 6

[56] References Cited

U.S. PATENT DOCUMENTS

| | | | |
|---|---|---|---|
| 636,295 | 11/1889 | Sibthorpe | 224/269 |
| 3,813,017 | 5/1974 | Pimsleur | 224/240 |
| 3,937,373 | 2/1976 | Artz | 224/252 |
| 4,058,853 | 11/1977 | Boxer et al. | 2/239 |
| 4,420,078 | 12/1983 | Belt et al. | 224/253 |
| 4,479,596 | 10/1984 | Swanson | 224/240 |
| 4,534,063 | 8/1985 | Krumin et al. | 224/199 |
| 4,572,415 | 2/1986 | Fehr | 224/253 |
| 4,771,927 | 9/1988 | Ventura | 224/901 |

*Primary Examiner*—Henry J. Recla
*Assistant Examiner*—Edward C. Donovan
*Attorney, Agent, or Firm*—William E. Koch; Vincent B. Ingrassia

[57] ABSTRACT

An improved carrying case for a small portable electronic device. The carrying case has a front panel, a back panel, two side panels and a bottom panel for defining a receptacle, open at its top, for closely receiving the device. A first flap at least partially covering the top of the device restrains the device inside the receptacle. A second flap having a fastener attaches the carrying case to an article of clothing of a user. The improvements of the case comprises a stiffener for the second flap and a protective flap for the fastener of the second flap.

5 Claims, 1 Drawing Sheet

FIG. 1
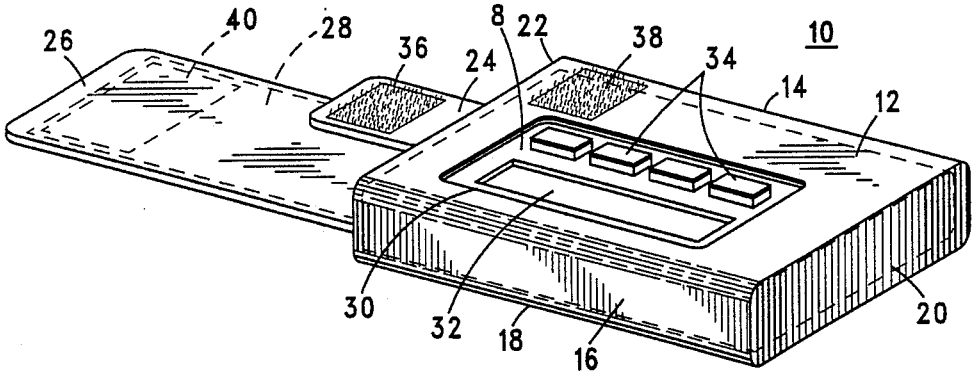
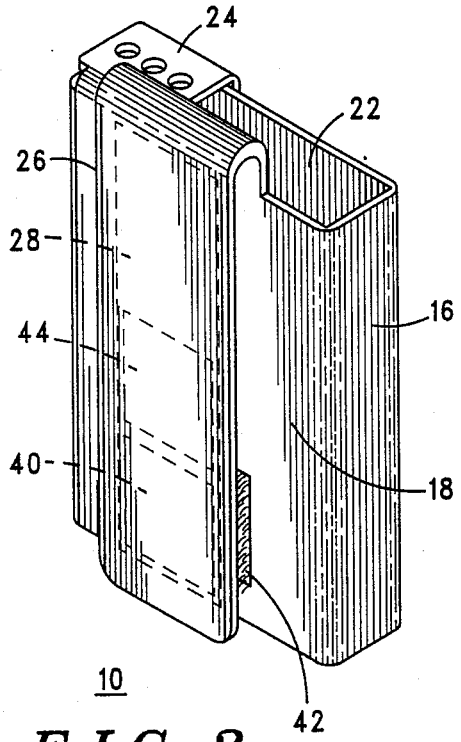
FIG. 2
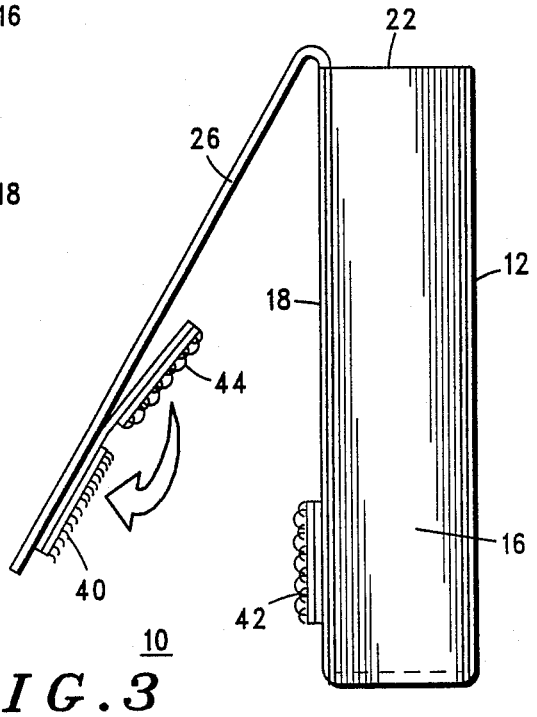
FIG. 3

CERTAIN IMPROVEMENTS TO A PAGER CARRYING CASE

BACKGROUND OF THE INVENTION

1. Field of the Invention

This invention relates to a carrying case for carrying small portable electronic devices, and more particularly, to certain improvements in a carrying case for a paging receiver.

2. Background of the Invention

Portable paging devices, also known as papers, are small portable radio receivers which are carried on a person and typically emit an audible or light signal whenever the pager is selected. Typically, there are four different pager types. First, a tone only pager generates a beep or flash upon being selected. Second, a tone and voice pager beeps and gives a short voice message for notifying the user. Third, a numeric display pager displays numeric messages such as phone numbers and other coded information. Finally, an alphanumeric display pager can receiver, store, and display completely written messages.

In particular, the numeric display and alphanumeric display pagers require a user to be able to read the display to receive this message. Numeric and alphanumeric display pagers also typically have a plurality of external control switches for allowing the user to read, protect, delete, and save the plurality of messages in the pager.

To facilitate the carrying of the pager, many types of carrying cases have been designed. A number of pager carrying cases have consisted of bulky clips which typically attach to the belt of the user. In operation, the pager had to be dislodged from the clip in order to enable the user to remove the pager from the belt, read the display and access the pager control switches. An example of this type of clip is illustrated in U.S. Pat. No. 4,534,063 issued to Krumin et al. and assigned to the assignee of the present invention. One known carrying case permitted the user to access at least one of the operating controls of the pager without disloding the pager from the belt and without removing the pager from the carrying case. Examples of this carrying case is illustrated in U.S. Pat. No. 4,479,596 issued to Swanson. Another U.S. Pat. No. 3,813,017 issued to Pimsleur illustrated a carrying case having access to a pistol grip of a camera included in the case. One, U.S. Pat. No. 4,420,078 issued to Belt et al. disclosed a front panel in which a liquid crystal display device is visible from the exterior of the electronic device's carrying case.

All of these cases, however, have been attached to a belt. For example, Pimsleur illustrates a flap attached by a VELCRO fastener to the carrying case to form a loop in which a belt is inserted through the loop. These types of carrying cases have worked well with the type of clothing which typically provided the belt support as illustrated in these patents.

However, it has become increasingly popular to wear beltless clothing. This popularity has even further increased in the female clothing market. Further, some clothing is of a delicate nature in which the intimate contact between the clothing and the hook type material of a VELCRO fastener sometimes leads to the fabric of the clothing being damaged. It would, therefore, be highly advantageous to design a carrying case that could be conveniently used by a beltless user.

SUMMARY OF THE INVENTION

Therefore, it is an object of the present invention to eliminate the problems of the prior art carrying cases by providing an improved support flap for a pager type carrying case for a beltless user.

It is a further object of the present invention to provide a protective flap for the fastener of the support flap to prevent damage to the clothing fabric of the user.

It is another object of the present invention to provide a stiffening element in the support flap of a pager carrying case.

In general, the pager carrying case comprises a front panel, a back panel, two side panels, and a bottom panel for defining a receptacle open at its top. Attached to the top are a first flap and second flap. The first flap secures the pager inside the case. The second flap supports the case and pager by either fastening the flap to the bottom of the case to define a loop for a belt or by having a stiffening element in the flap to permit the flap to support the case when the flap is inserted into the pant's top or the like.

A further improvement includes a protective flap for covering the fastening elements of the fastener. The protective flap prevents damage to the clothing fabric of the user.

DESCRIPTION OF THE DRAWINGS

FIG. 1 is a left front perspective view of the carrying case of the present invention.

FIG. 2 is a right back perspective view showing the improved belt fastener for the carrying case.

FIG. 3 is a right view illustrating the protective flap on the hook portion of a VELCRO fastener.

DESCRIPTION OF A PREFERRED EMBODIMENT

Referring to FIG. 1 in greater detail, the carrying case of the present invention is shown. The case 10 includes a front panel 12, a first side panel 14, a second side panel 16, a back panel 18, and a bottom panel 20. The panels define a receptacle, open at its top 22, for closely receiving a paging receiver 8. The portable paging receiver 8 (in phantom) is shown located within the case. The case 10 further includes a first flap 24 for securing the paging receiver 8 securely within the case and a second flap 26. The second flap 26 can form a loop for attaching the carrying case onto the belt of the user. As will be explained later, the second flap 26 may include a stiffening element 28 (shown in phantom) for effecting the support of the case on the person of a user by inerting the second flap 26 into the pant's top or the like. The case 10 further includes a cut out window 30 for permitting the display 32 of the pager 8 to be visible from the exterior of the carrying case. Additionally, the window 30 allows the operating controls 34 of the pager 8 to be accessible from the exterior of the carrying case 10. Thus, the user can operate the controls 34 of the pager 8 without the necessity of removing the pager from the carrying case 10.

In operation, the pager 8 is inserted into the carrying case 10 through the open top 22. The first flap 24 is folded over part of the pager 8 and extends in a downward direction. A portion of the first flap includes a fastening surface 36 comprised of either a hook or pile surface fastening material. A second fastening surface 38 on the front panel 12 is comprised of a complementary hook or pile surface to permit the first flap to be secured to the front panel. The complementary hook and pile surface, such as VELCRO, prevents the first flap 24 from being separated from the case 10 and thus retains the pager 8 in the case 10.

Referring now to the second flap 26 in further detail, a stiffener 28 may be added to the second flap 26 for effecting the support of the case in a pocket of the user. The stiffener 28 is comprised of a stiff flexible material which can be made out of thin metal, thin hard plastic, or thin pliable plastic. When the second flap 26 is inserted into the pocket or a belt of the user, the force exerted by the pocket or belt on the stiffener 28 prevents the case from falling. Alternatively, the second flap 26 can include a portion at the end having a fastening surface 40. The fastening surface 40 is comprised of either a hook or pile surface fastening material, such as VELCRO.

In operation, the second flap 26 extends in a general downward diection towards the bottom panel 20. A complementary fastening surface 42 (shown in FIG. 3) is attached to the bottom of the back panel 18. The fastening surface 42 is comprised of a complementary hook or pile surface for effecting the securing of the bottom of the second flap 26. Securing the second flap 26 forms a loop in which a belt can be inserted to support the case 10 and pager.

Referring now to FIG. 2 showing a back perspective view of the case 10, the operation of the second flap 26 can be clearly seen. In a first mode of operation, the second flap 26 includes the complementary hook and pile surfaces 40 and 42 for fastening the bottom portion of the second flap 26 around the belt of a user. In this particular mode of operation, the second flap 26 forms a loop which permits a belt to be inserted into the loop to securely fasten the carrying case to the belt. In a second mode of operation, the second flap 26 includes a stiffener 28 which can be inserted into the pocket or other opening of the clothing to support the case and pager. It is understood that the stiffener 28 is made from a stiff flexible material so that the stiffener can be utilized in both modes.

Referring now to FIG. 3, there is shown a right side of the case 10 illustrating in greater detail the second flap 26 and a protective flap 44. When the second flap 26 is not used in the loop configuration, the protective flap 44 having the opposite pile elements of the fastening surface 40 can be attached to the fastening surface 40 to prevent the hook elements from damaging any of the clothing. As can be appreciated, if the hook elements are secured to the bottom portion of back panel 18, the protective flap is then attached to the back panel. In either embodiment, the protective flap prevents the hook elements from damaging the fabric of the clothing. Thus, the protective flap will be attached to the hook elements of the VELCRO fastener. As can be appreciated, the use of the protective flap prevents damage of the clothing of the user.

Thus, there has been shown a carrying cae for a paging receiver having the improvements of a stiffener in the securing flap fastener for supporting the carrying case without the aid of a belt. Additionally, a further improvement comprises a protective flap which attaches to the hook elements of a VELCRO fastener to prevent damage to the clothing of the user.

While a particular embodiment of the invention has been shown and described, it will be obvious to those skilled in the art that changes and modifications may be made without departing from the invention and its broader aspects, and therefore, the aim in the amended claims is to cover all such changes and modifications as fall within the true spirit and scope of the invention.

What is claimed is:

1. An improved carrying case for a small portable electronic device for attaching to an article of clothing, the device having a display to read information and a plurality of control keys, the carrying case having a front panel, a back panel, two side panels and a bottom panel for defining a receptacle, open at its top, for closely receiving the device, wherein the improvement comprises:

a first flap at least partially covering the top of the device to restrain the device inside the receptacle;

a second flap for attaching the carrying case to said article of clothing; and a stiffening element enclosed within said second flap, said stiffening element stiffening said second flap to structurally support said carrying case containing said device on the article of clothing;

wherein said front panel allows user accessibility to at least one of said plurality of control keys of said electronic device and allows user viewability of said display of said electronic device, a fastening means having a first surface on said second flap and a second surface on said back panel, said first surface comprising a hook material and said second surface comprising a complementary pile material for securing said second flap extending downwardly from where said second flap adjoins said top panel towards where said bottom panel adjoins said back panel to form a loop; and a third flap comprised of said complementary pile material, said third flap being connected to said first surface along a first side such that said third flap can be rotated around an axis defined by said first side to be in a first position and a second position where said third flap in said first position is disengaged from said hook surface on said second flap and lies adjoining said first surface in said plane and said third flap in said second position extends over and substantially covers said hook surface.

2. An improved carrying case for a small portable electronic device for attachment to an article of clothing, the device having a display to read information and a plurality of keys for control of said device, the carrying case having a front panel, a back panel, two side panels and a bottom panel for defining a receptacle, for closely receiving the device, wherein the improvement comprises:

a first flap for attaching the carrying case to said article of clothing;

complementary hook and pile surfaces for securing said first flap extending downwardly from said back panel towards where said bottom panel adjoins said back panel to form a loop; and a second flap comprised of the complementary pile material, said second flap being connected to said hook surface along a first side such that said second flap can be rotated around an axis defined by said first side to be in a first position and a second position where said second flap in said first position is disengaged from said hook surface and lies adjoining said hook surface and said second flap in said second position extends over and substantially covers said hook surface.

3. The improvement of claim 4 further comprising a stiffening means enclosed within said first flap, said stiffening means being comprised of a stiff flexible material to structurally support said carrying case in the pocket of a user's clothing.

4. The improvement of claim 3 wherein the stiff flexible material is plastic.

5. An improved carrying case for a small portable electronic device for attaching to an article of clothing, the device having a display to read information and a plurality of control keys, the carrying cae having a front panel, a back panel, two side panels and a bottom panel for defining a receptacle, open at its top, for closely receiving the device, wherein the improvement comprises:

a first flap at least partially covering the top of the device to restrain the device inside the receptacle;

a second flap for attaching the carrying case to said article of clothing;

a stiffening element enclosed within said second flap, said stiffening element stiffening said second flap to structurally support said carrying case containing said device on the article of clothing;

wherein said front panel allows user accessibility to at least one of said plurality of control keys of said electronic device and allows user viewability of said display of said electronic device;

a fastening means having a first surface on said back panel and a second surface on said second flap, said first surface comprising a hook material and said second surface comprising a complementary pile material for securing said second flap extending downwardly from where said second flap adjoins said top panel towards where said bottom panel adjoins said back panel to form a loop; and a third flap comprised of said complementary pile material, said third flap being connected to said first surface along a first side such that said third flap can be rotated around an axis defined by said first side to be in a first position and a second position where said third flap in said first position is disengaged from said first surface on said back panel and said third flap in said second position extends over and substantially covers said hook surface.

* * * * *